US006993939B2

(12) United States Patent
Franzke et al.

(10) Patent No.: US 6,993,939 B2
(45) Date of Patent: Feb. 7, 2006

(54) METHOD AND SYSTEM FOR PRODUCING A MULTI-LAYER, PRE-FIXED THREAD OR FIBER ARRANGEMENT

(75) Inventors: Gerd Franzke, Dresden (DE); Markus Schierz, Freiberg (DE); Claus Schierz, Freiberg (DE); Martin Waldmann, Dresden (DE)

(73) Assignee: Karl Mayer Malimo Textilmaschinenfabrik GmbH, Chemnitz (DE)

( * ) Notice: Subject to any disclaimer, the term of this patent is extended or adjusted under 35 U.S.C. 154(b) by 110 days.

(21) Appl. No.: 10/497,713

(22) PCT Filed: Dec. 19, 2002

(86) PCT No.: PCT/DE02/04647

§ 371 (c)(1),
(2), (4) Date: Dec. 2, 2004

(87) PCT Pub. No.: WO03/056085

PCT Pub. Date: Jul. 10, 2003

(65) Prior Publication Data

US 2005/0123715 A1 Jun. 9, 2005

(30) Foreign Application Priority Data

Dec. 21, 2001 (DE) ..... 101 63 683

(51) Int. Cl.
*D04B 21/14* (2006.01)

(52) U.S. Cl. ..... 66/84 A

(58) Field of Classification Search ..... 66/84 R, 66/84 A, 83, 202, 190–195; 28/102, 107, 28/108; 442/305, 312–313
See application file for complete search history.

(56) References Cited

U.S. PATENT DOCUMENTS 3,756,893 A * 9/1973 Smith ..... 28/107
3,761,345 A 9/1973 Smith
4,325,999 A 4/1982 Campman et al.

(Continued)

FOREIGN PATENT DOCUMENTS

DE 2 763 1/1955

(Continued)

*Primary Examiner*—Danny Worrell
(74) *Attorney, Agent, or Firm*—Jordan and Hamburg LLP

(57) ABSTRACT

The invention relates to a method and a system for producing a multi-layer thread or fibre arrangement (GF) which is pre-fixed by means of a loop structure and is used a s a strip-type semi-finished product for reinforcing elements consisting of plastic or resin. Said fibre arrangement (GF) comprises layers consisting of stationary weft yarns (K) and layers consisting of thread or fibre warps (S, D,D') which are stretched between conveyor chains in such a way that they are oriented in different directions. The aim of the invention is to reduce the costs and the required surface mass, simultaneously maintaining defined, required flexural strength. To this end, the method is designed in such a way that the stationary weft layer (KR) consisting of fibre or thread warps and oriented parallel to the working direction is located directly adjacent to the needle loops (WN) of the loop structure, and needle loops (WNv) of the loop structure cross the threads or fibres of the stationary weft layer, in the knock-over phase, before the knitting needles (1) penetrate the thread arrangement (G) in order to create a successive row of loops.

18 Claims, 6 Drawing Sheets

U.S. PATENT DOCUMENTS

| | | | | | |
|---|---|---|---|---|---|
| 4,567,738 | A | * | 2/1986 | Hutson et al. | 66/85 A |
| 4,703,631 | A | * | 11/1987 | Naumann et al. | 66/84 A |
| 4,872,323 | A | * | 10/1989 | Wunner | 66/84 A |
| 5,809,805 | A | * | 9/1998 | Palmer et al. | 66/84 A |
| 6,151,923 | A | * | 11/2000 | Gruenert et al. | 66/84 A |
| 6,668,596 | B1 | * | 12/2003 | Wagener | 66/84 A |

FOREIGN PATENT DOCUMENTS

| | | |
|---|---|---|
| DE | 33 04 345 | 8/1984 |
| DE | 33 43 048 | 6/1985 |
| DE | 199 13 647 | 9/2000 |
| FR | 2 594 858 | 8/1987 |
| WO | WO 98 10128 | 3/1998 |

* cited by examiner

METHOD AND SYSTEM FOR PRODUCING A MULTI-LAYER, PRE-FIXED THREAD OR FIBER ARRANGEMENT

BACKGROUND OF THE INVENTION

The invention relates to a method and a system for producing a multistratum, preset, i.e., preconsolidated, thread- or fiber fabric that is used as an elongated semi-finished product for reinforcing parts made of plastic or resins and that in the individual strata comprises thread- or fiber sheets, each of which is oriented differently, whereby in at least one of the strata—a stationary weft stratum—thread- or fiber sheets is oriented largely parallel to the working direction, whereby at least one of the strata comprises thread- or fiber sheets that are stretched between rows of hooks of conveyor chains on both sides of a laying arrangement for producing the thread fabric, whereby the thread- or fiber fabric is supplied to a warp knitting machine at the speed of the aforesaid transport chains and there—stretched between the transport chains—is preset by means of a system of loops and whereby needle loops and plate loops of the system of loops enclose threads or fibers of all strata of the thread- or fiber fabric.

In the production of multistratum, pre-consolidated thread fabrics that are impregnated or cast-in with resin or plastic in a subsequent process and finally cured in a pre-selected shape into semi-finished products for various final products, the exterior thread- or fiber layer is in many respects determinant for the properties or employment of the semi-finished product.

Especially for band-shaped, i.e., elongated, workpieces, flexural resistance transverse to their longitudinal axis to a great extent determines how they can be used. This is particularly true for aircraft skins and ship hulls. In this case there is the additional challenge of making the semi-finished products light and cost-effective.

Another determining feature is the visual surface of such a structure. It is generally desirable that the surface adapts to the structure of the future product or does not interfere therewith.

Thread fabrics of this type are generally preset on the warp knitting machine using the so-called stitch bonding method. In known warp knitting machines, so-called stationary weft threads that extend across lengthy segments exclusively in the working direction of the warp knitting machine cannot be inserted on the right-hand side of the knitted fabric. The "right-hand" side of the knittted fabric is the side the knitting needles first penetrate. If the illustrations of the knitting machine, e.g., FIG. 1, are rotated 90° counterclockwise, it is seen that the aforementioned side is the "right-hand side." Insofar as the multi-strata fabric is concerned, the outermost stratum on the right-hand side will be designated the "lowermost" stratum and the outermost stratum on the other side will be designated the "uppermost stratum."

On such machines, the only thread- or fiber fabrics that can be compressed and preset are those that have diagonal or transversely laid thread- or fiber strata on their lower side, the right-hand side of the knitted fabric. Such thread- or fiber systems can be stretched between conveyor chains and guided in the cast-off plane to the loop formation site of a warp knitting machine with no problem.

For assuring symmetrical stability under load of the reinforcing thread fabric, the fabric structure is generally designed approximately symmetrical. One stratum or a plurality of strata of thread sheets that are inclined at different angles to the working direction is/are added to a center layer of weft threads thereabove and therebelow.

For assuring relatively high flexural resistance of the semi-finished product transverse to the working direction, the exterior stratum is designed with a very small angle—generally 30°—to the working direction of the thread fabric. However, this requires extremely long laying arrangements for producing these fiber fabrics. At an angle of inclination of 30° relative to the working direction and a warp knitting machine with a working width of more than 100 inches, the laying arrangement with three laying apparatus is already more than 10 meters long.

The conveyor chains that stretch and transport the thread fabric are subject to high wear. Laying apparatus with large dimensions are expensive and require constant maintenance.

The following documents define the state of the art in this field:

U.S. Pat. No. 3,761,345 provides originally used systems and methods for producing the cited thread- or fiber fabric. In each case, the lowermost thread layer or stratum is provided with primarily transversely-oriented thread- or fiber sheets that are stretched between the conveyor chains.

Most of the other thread layers are laid cross-wise or in a zigzag pattern so that there are numerous areas on the thread fabric that have different thicknesses.

To avoid the visually unsatisfactory surface, fiber snippings are applied to the left-hand side of the thread fabric and bound thereto in the knitting process. A second knitting process is required for covering the right-hand side of the knitted fabric with the same type of fiber snippings.

In accordance with U.S. Pat. No. 4,325,999, thread- or fiber sheets are placed only parallel to one another to counter areas in the thread sheet that have different thicknesses.

For attaining particularly high rigidity relative to bending transverse to the longitudinal direction, at least two strata that have straight threads parallel to one another and that are inclined only 30° to the working direction were added to the knitted fabric/thread fabric. Such a form for the thread fabric is not suitable either, as already mentioned, for satisfying the user requirements as defined in the foregoing.

With enlarging the working width of the thread fabric to more than 100 inches (=2.52 m) and with the increasing desire for a greater number of thread- or fiber strata, it became increasingly difficult to supply the produced thread fabric in a stable manner between the conveyor chains of a warp knitting machine.

In accordance with DE 198 52 281 A1, positioned below the laying apparatus and between the transport chains is a continuous conveyor belt, the upper run of which was supported from below. However, the dimensions of the conveyor belt made it necessary to reliably guide the thread fabric from the moved conveyor belt across an open distance to the cast-off plane of the warp knitting machine. The diagonal lower thread layer was used for this, as well.

For additionally assuring guidance in the transition from the moved to the frame-fixed guide, in one exemplary embodiment continuous guide wires were used together with the conveyor belt, and these could be guided through the spaces of the needles in the cast-off plane without their being tied up therein. These continuous guide wires could be guided back to the entry of the laying arrangement and onto the conveyor belt. Such guide wires and guiding them are extremely expensive and solve only the last-cited problem.

It can therefore be assumed that the thread fabrics that reinforce large surface area, flat, elongated semi-finished products have a structure such as that illustrated and described in DE 33 04 345 C2 and DE 33 43 048 A1. The required flexural stiffness in one direction is primarily provided by a single stationary thread system or at most by two stationary thread systems.

All other diagonal thread systems contribute only as more or less elastic members in a limited manner to increasing the flexural resistance in the cited direction. For one skilled in the art, it is clearly evident that thread fabrics embodied in this manner are only somewhat stable against bending transverse to the longitudinal direction of the semi-finished product. Generally additional reinforcing elements are added for assuring a predetermined flexural stability, but this increases mass and raises costs.

The object of the present invention is to suggest a method and a system for producing a multistratum preset thread- or fiber fabric that makes it possible to arrange optimally effective reinforcing elements as far as possible from the neutral bending line for assuring the necessary flexural stability of thread- or fiber-reinforced semi-finished products and makes it possible to use to the greatest extent possible existing elements or elements that are low in mass for setting on the thread- or fiber fabric.

SUMMARY OF THE INVENTION

This object is achieved by claim 1 in a surprisingly simple manner. The individual strata comprise thread or fiber fabrics or sheets each of which is oriented differently. At least one of the strata is a stationary weft stratum. A thread or fiber sheet comprising the stationary weft stratum is oriented substantially parallel to the machine direction. The stationary weft stratum is the lowermost stratum of the multi-strata fabric and is comprised of threads or fibers stretched between rows of hooks on laterally spaced substantially parallel conveyor chains which convey the weft threads or fibers to a warp knitting machine. The warp knitting machine forms loops which bind threads or fibers of all the strata to preconsolidate the multi-strata fabric. The needles penetrate the multistrata fabric to form needle loops. The lowermost stratum is immediately adjacent the needle loops. The needle loops comprise legs which in a stage of a row of needle loops being cast off cross one another due to a relative mutual displacement of the needle loops and the stationary weft threads relative to a preceding cite at which a preceding row of needle loops were formed to bind the threads or fibers. Subsequently penetrating the multi-strata fabric again with the row of needles to form a subsequent row of loops binding additionally binding the threads or fibers. With the arrangement of a stationary weft stratum that is immediately adjacent to the needle loops of the system of loops, and with an orientation of the needle loops crossing the stationary wefts on the right-hand side of the system of loops, the stationary weft stratum is held reliably and in a stable manner on the entire preset thread fabric.

First of all, it is possible to insert stationary weft threads in a stable manner on the right-hand side of the system of loops. The preconsolidated thread fabric when used alone can be stored for the interim with no folds by rolling it. If stationary weft thread systems are arranged on both exterior sides of the thread fabric, high flexural resistance is obtained in the final state.

The designer of a semi-finished product is provided the opportunity to insert between the stationary thread systems any desired strata that meet the requirements, that can provide a certain distance between stationary thread strata, and that can effect additional reinforcing in secondary directions.

Frequently less compact fiber or non-woven fabric elements can provide reinforcing in secondary directions. These fiber or non-woven fabric elements generally have less mass and are easier to produce and supply. The arrangement of the visible fiber or thread strata symmetrical to the longitudinal direction in many cases makes additional measures unnecessary in terms of the structure of the surface.

By further modifying the method, with a limited needle bar displacement it is possible to keep the required modifications to the previous method in a limited frame and to provide high functionality in the method. In another aspect of the invention, the threads or fibers of the lowermost stationary weft stratum are supported upstream and downstream of the needles. Also, the threads or fibers of the lowermost stationary weft stratum are stretched in the working direction against pressure applied to the threads or fibers by the casting off. The stretched threads or fibers guide the lowermost stationary weft stratum in a plane of the casting off across a plane of the needles. Needle loops guided by the needles after crossing over threads or fibers of the lowermost stationary weft stratum are deposited and cast off with the aid of needle loops of the subsequent row of loops. By avoiding cast-off elements that engage in the spaces between the needles, the needle displacement process is realized largely with no risk in the cast-off phase. The absence of knock-over bits in the area of the needle plane permits high working speeds for the warp knitting machine and permits the use of crank-controlled needle drives. The required gauge accuracy for laying the working threads into the needle hooks can be assured in the usual gauges.

The object set forth can also be achieved according to another aspect of the invention while avoiding a needle bar displacement. The cast off elements are laterally displaced by at least one gauge during the cast off phase, and the needle loops are guided by non-laterally displaceable knitting needles after the displacing of the threads or fibers. This also then assures adequate lateral setting of the thread fabric, if no cast-off elements on the exit sites of the needle loops from the thread fabric set these transverse to the working direction. The stationary wefts that are under the greatest lateral load due to the displacement of the needle loops are set by the projecting profiles. Upward creeping is effectively prevented by the thread fabric situated thereover.

A displacement that effects the crossing of needle loops and stationary weft threads or fibers is provided by the cast-off bar. The guide elements for the laterally displaceable cast-off generally capture only the threads of the stationary weft stratum. The thread or fiber strata situated thereover, which are transversely oriented, are prevented from displacement by their position and by the tension produced between the conveyor chains.

For fixing coarse thread fabrics with a system of loops with large gauge distances, it is of course also possible to provide the cast-off by needle-shaped or tube-shaped cast-off elements that are oriented in the cast-off direction and that entirely or partially pass through the needle spaces. For coarse thread fabrics, the working speed of the warp knitting machine is lower. Collisions between these needle-shaped cast-off elements and the knitting needles are nearly impossible.

It has proved useful to provide the cited stationary weft stratum on the right-hand side of the knitted fabric as the first stratum of the thread fabric and then to build up the thread fabric on this stratum and finally to guide the finished fabric into the cast-off plane.

Incorporating a stratum made of stationary weft threads assures the theoretically highest flexural resistance of the semi-finished product in a definable manner.

Modifications to the method lead to thread fabrics of different quality that can be selected depending on the demands placed on the semi-finished product.

Also according to the invention, apparatus is provided for producing a preconsolidated elongated multi-strata fabric. The apparatus includes a pair of substantially parallel conveyor chains provided with hooks for engaging threads or fibers stretched between the conveyor chains. A thread or fiber supply apparatus provides stationary weft threads or fibers. At least one thread or fiber laying apparatus is provided for forming thread or fiber sheet comprised of threads or fibers stretched between the conveyor chains. A conveyor belt is arranged between the conveyor chains for supporting and transporting a thread or fiber fabric. The apparatus also includes a warp knitting machine, preferably a stitch bonding machine, having knitting needles arranged for transversely penetrating the thread or fiber sheet and fabric in a casting off plane in a loop formation zone of the knitting machine. Guide elements for the conveyor chains are arranged between the laying apparatus and the loop formation zone. In an entry area of the laying apparatus is provided a thread or fiber supply apparatus for stationary weft threads for guiding a sheet of stationary weft threads to form a lowermost stratum of the multi-strata fabric. The knitting machine has a cast off bar at least a part of which is arranged on a side of the needle face of the knitting needles and in proximity thereto. Associated with the cast off bar are guide elements which counter force applied in the cast off direction and for lateral guidance of the thread or fiber fabric against displacement of thread or fiber loops formed by the knitting needles.

According to another aspect fo the invention, the apparatus may include apparatus for supplying a stratum of tangled fibers of predetermined length, arranged below the thread or fiber fabric and immediately in front of the cast off bar of the warp knitting machine. Between the apparatus for supplying the stratum of tangled fibers and the cast off bar is provided means for holding those fibers on the lowermost stratum. The means for holding the fibers may comprise an air duct bar.

Preconsolidated elongated thread or fiber multi-strata fabric of the invention is especially suitable for reinforcing articles comprised of resin or plastic. The fabric comprises a lowermost stratum comprised solely of thread or fiber sheet oriented at least in part as stationary weft threads or fibers substantially parallel to the longitudinal axis of the multi-strata fabric. Needle loops formed by needles of a knitting machine, preferably a stitch bonding machine, include legs binding the stationary weft threads or fibers. The multi-strata fabric may also include an uppermost stratum comprised solely of thread or fiber sheet oriented at least in part as stationary weft threads or fibers substantially parallel to the longitudinal axis of the multi-strata fabric. Plate loops formed by the needles bind the stationary weft threads or fibers of the uppermost stratum. The multi-strata fabric may, furthermore, include, between the uppermost stratum and the lowermost stratum, transversely oriented weft threads or fibers of predetermined length. The needle loops and the plate loops also bind the transversely oriented weft threads or fibers.

BRIEF DESCRIPTION OF THE DRAWINGS

The invention shall be explained in greater detail in the following using exemplary embodiments. The drawings illustrates.

DETAILED DESCRIPTION OF EMBODIMENTS OF THE INVENTION

Figure 1:
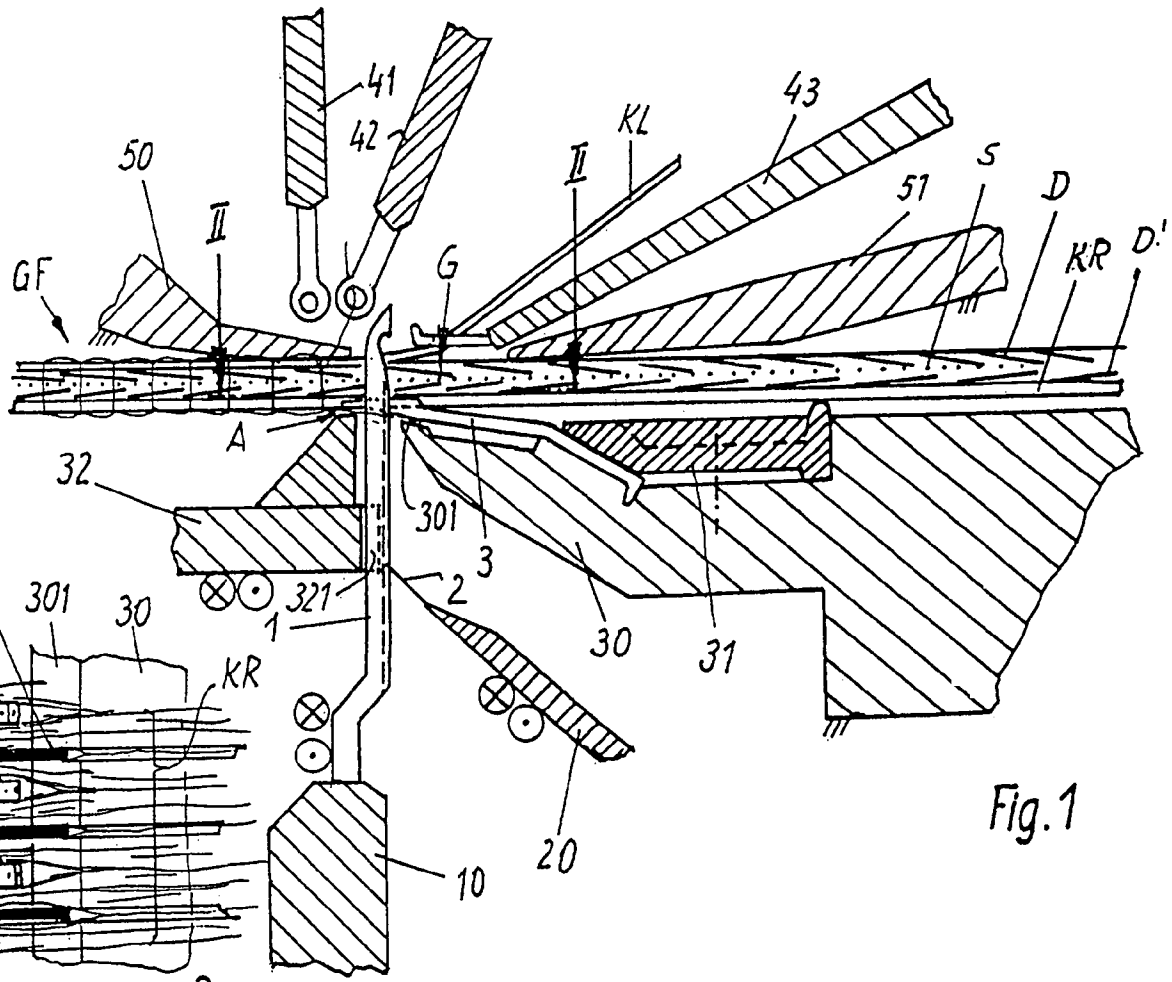
FIG. 1 a section through the loop formation site of a warp knitting machine for consolidating a thread fabric, whereby the needle bar, the slider bar, and a part of the cast-off bar perform a lateral displacement movement.

The section of a loop formation site of a warp knitting machine illustrated in FIG. 1 is constructed according to the principle of stitch bonding. The vertically arranged knitting needles 1, which are embodied here as slide needles with sliders 2, have at their head a tip that can upwardly penetrate the thread fabric from below at any desired site.

The knitting needle bar 10 and thus also the slide bar 20 are laterally displaceable in the cast-off phase, that is, when their needle tip is located below the thread fabric G and below the cast-off element 3. The thread fabric G is guided in the cast-off plane by the lateral conveyor chains (not shown) and by cast-off means 3. These cast-off means 3 are held on the side of the needle face in the cast-off bar 30 using conventional clamping plates 31.

The cast-off means 3, whose shaft is embodied with limited elasticity, can be caught immediately in front of the needle face at a support surface 301 of the cast-off bar 30.

When producing strong thread fabric G, it is useful to catch the cast-off elements 3 behind the back of the knitting needle 1 again, as well. The support bar 32 can take on this task at A. This support bar 32 in addition has at its side facing the needle plane gauge-appropriate guide projections 321 that can guide laterally at a distance that remains the same under the cast-off plane of the shafts of the knitting needles 1.

This guide for the knitting needles 1 can receive a portion of the lateral forces that the just-formed needle loops WN exert during displacement onto the hooks of the displaceable knitting needles 1. At its top side, the fiber fabric G, GF is secured against vertical lifting by holders 50 and 51. Allocated to the knitting needle 1 are preferably two guide bars 41, 42 that can supply knitting threads W in a different manner in tricot- or fringe laying.

The thread fabric G in this case comprises a central weft thread layer S, two adjacent diagonal thread layers D, D' above and below this weft thread layer S, a lower stationary weft layer KR and an upper stationary weft layer KL. The upper stationary weft layer KL is supplied by a corresponding stationary thread guide 43, but not until the area of the loop formation site.

Figure 2:
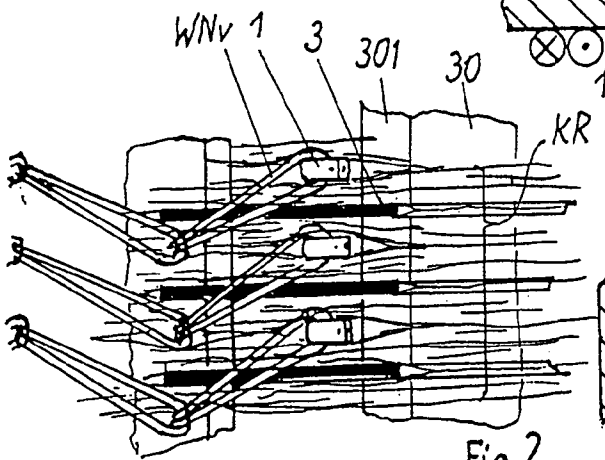
FIG. 2 is a section in the plane of the thread fabric above the bottom stationary weft stratum in the region of the cast-off plane along the line II—II in FIG. 1.

FIG. 2 illustrates a phase in which the tips of the knitting needles 1, after the needle loop displacement below the cast-off plane, re-penetrate into the thread fabric G. The cast-off elements 3 arranged between the needle spaces pass through the thread- or fiber sheet KR and guide the thread fabric G using their sliding contact with the lower diagonal thread layer D'.

The laterally displaced needle loops WNv grab these cast-off elements 3 from below and also the fibers of the stationary thread stratum KR that are guided between these cast-off elements 3. When the knitted ware continues, the displaced needle loops WNv are pulled downward by the free ends of the cast-off elements 3.

This embodiment has particular advantages when the thread fabric is to be preset in a coarser gauge. The risk of the tips of the knitting needles 1 colliding with the cast-off elements is then relatively low.

Figure 3:
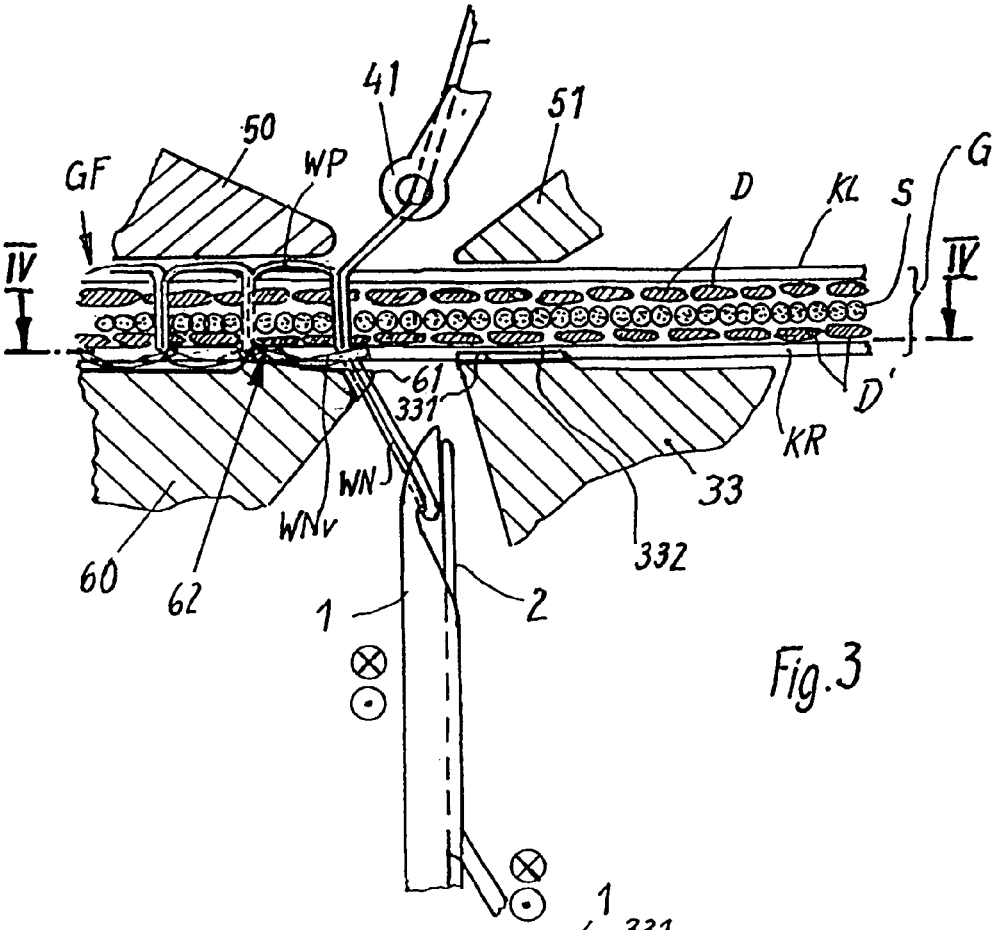
FIG. 3 is an enlarged detail from the loop formation site of a warp knitting machine with a modified cast-off design without knock-over bits in the needle spaces.

With the embodiment of the cast-off in accordance with FIG. 3, the goal is to perform pre-consolidation of the thread fabric with a system of loops that is less fine and with shorter stitch lengths. For avoiding collisions between the knitting needles 1 and the cast-off elements 3, the lower stationary weft threads or fibers KR guide the thread fabric G across the plane of motion of the knitting needles 1.

For avoiding deflection of the thread fabric G during the cast-off motion, a first support bar 33 with a fiber divider 332 and a support surface 331 are fixedly arranged immediately in front of the needle plane (plane of the knitting needles 1) on the side of the needle face.

A second support bar is situated immediately behind the back of the row of knitting needles 1; we can also call it the cast-off bar 60. This cast-off bar 60 also has guide profiles that engage between stationary threads or fibers KR of the thread fabric G. A cast-off nose 61 holds the exit site of the needle loop WN from the preceding stitch hole whenever the knitting needles 1 are laterally displaced in the cast-off position.

This embodiment has the advantage that only the thread fabric G that can be easily penetrated by the knitting needles 1 at any desired site is located in the movement plane of the knitting needles 1. Collisions that can occur due to different tensions in the needle loops WNv or WN are therefore prevented. The thread fabric G itself in this case is constructed the same as that which was described with regard to FIG. 1.

Figure 4:
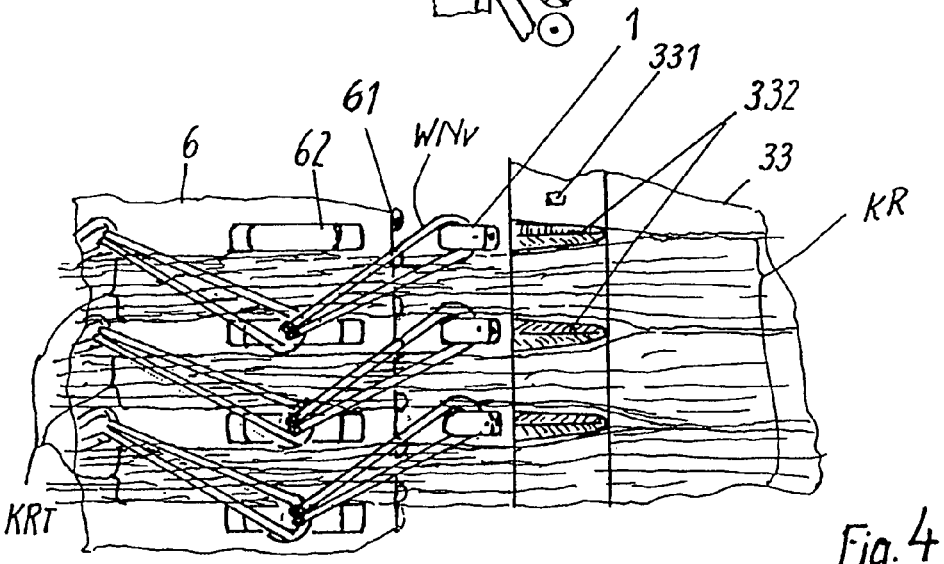
FIG. 4 is a section along the line IV—IV in FIG. 3.

FIG. 4 is a section along the plane IV—IV in FIG. 3. This section is from immediately above the lowermost stationary thread or stationary fiber stratum KR. FIG. 4 is intended to illustrate how the profiles 332, 62, 61 are embodied and arranged on the support bar 33 and the cast-off bar 60 so that they can correctly perform their casting-off function and their lateral guiding function with respect to the stationary fibers or stationary threads KR and the displaced needle loops WNv.

The fiber sheet KR coming from the right in FIG. 2 is guided on the support bar 33 from below by the support surface 331 near the plane of motion of the knitting needles 1.

Attached to the support bar 33 immediately in the plane in which the needles poke into the thread fabric G are fiber dividers 332 that press the fiber stratum KR into the spaces between the knitting needles 1. Their upper edge guides the diagonal thread or fiber sections D'. Their length should be selected such that two successive diagonal threads D' are supported by the fiber dividers 332. Arranged immediately behind the knitting needles 1 is the cast-off bar 60, which guides from below the fiber stratum KR that has already been bound in. Provided behind each of the knitting needles 1 are guide profiles 62 for the lower thread- or fiber stratum KR, which guide the thread fabric G in the spaces that the fiber dividers 332 have prepared.

With their upper surfaces these guide profiles 62 also simultaneously support at least two threads of the diagonal thread stratum D. The so-called cast-off noses 61, which can be situated laterally behind each needle shaft, hold in the cast-off position the feet of the needle loops WNv against the displacement movement of the knitting needles 1 at the preceding position and in this manner effectively prevent the thread- or fiber fabric G from displacing particularly into the center area of the thread fabric. In addition, the fiber- or thread fabric is fixed laterally externally by the conventional conveyor chains 8, 8'.

Figure 5:
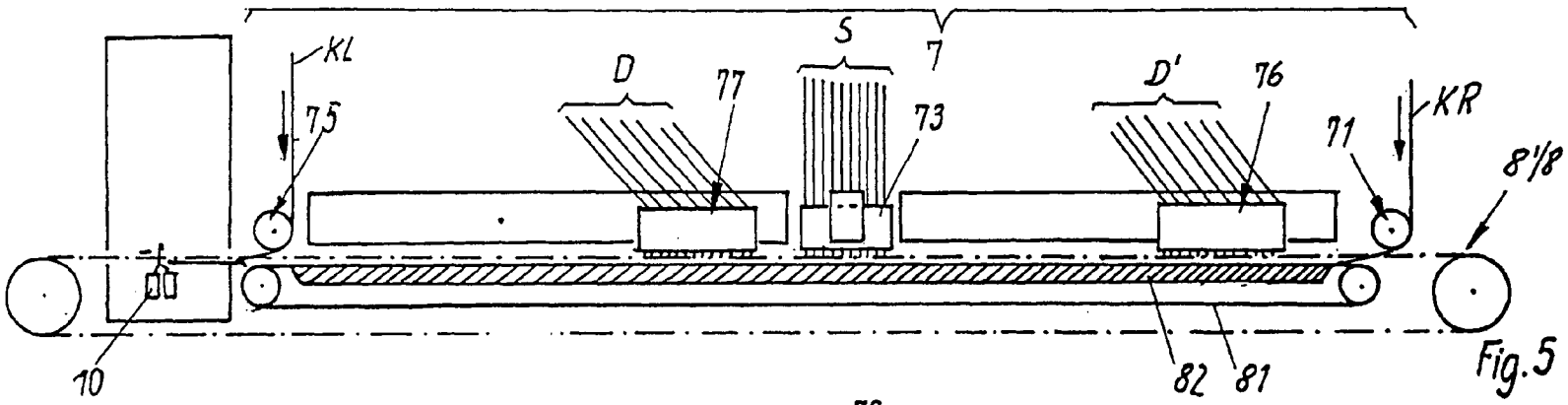
FIG. 5 is a schematic longitudinal section through the system for producing a preset thread- or fiber fabric.

FIG. 5 demonstrates the type of production of the thread fabric G for performing the present invention. The laying arrangement 7 is arranged in the area of the upper run of the conveyor chains 8, 8'. Situated in the laying area below the plane of the upper run is a continuous conveyor belt 81 that supports the thread fabric G from below in the phase of its production between the conveyor chains 8, 8'. A guide plate 82 assures the exact position of the upper run of this conveyor belt 81.

As the first stratum, the lowermost stationary thread stratum KR is fed as the thread sheet via the thread supply apparatus 71 onto this conveyor belt 81, the upper run of which moves synchronously with the conveyor chains 8, 8', in the direction of the warp knitting machine with its knitting needle bar 10. The first diagonal thread layer D' is applied to this first thread stratum KR by means of the thread laying apparatus 76. The following weft laying apparatus 73 stretches a thread sheet S between the two conveyor chains 8, 8' before another thread laying apparatus 77 lays the diagonal thread layer D about the hooks of the conveyor chains 8, 8'. The uppermost stationary weft layer KL is applied to the thread fabric G as the last thread sheet using the thread supply apparatus 75.

The thread fabric G assembled in this manner is pre-consolidated in the warp knitting machine by means of a knitting needle bar 10, which is a component of the loop formation zone. See FIGS. 1 and 3. The knitting needle bar 10 forms a system of loops from plate loops WP and offset needle loops WNv. The offset needle loops WNv hold the lower stationary thread layer KR on the thread fabric G, while the plate loops WP, provided in tricot lay, enclose the upper stationary thread layers KL.

Figure 6:
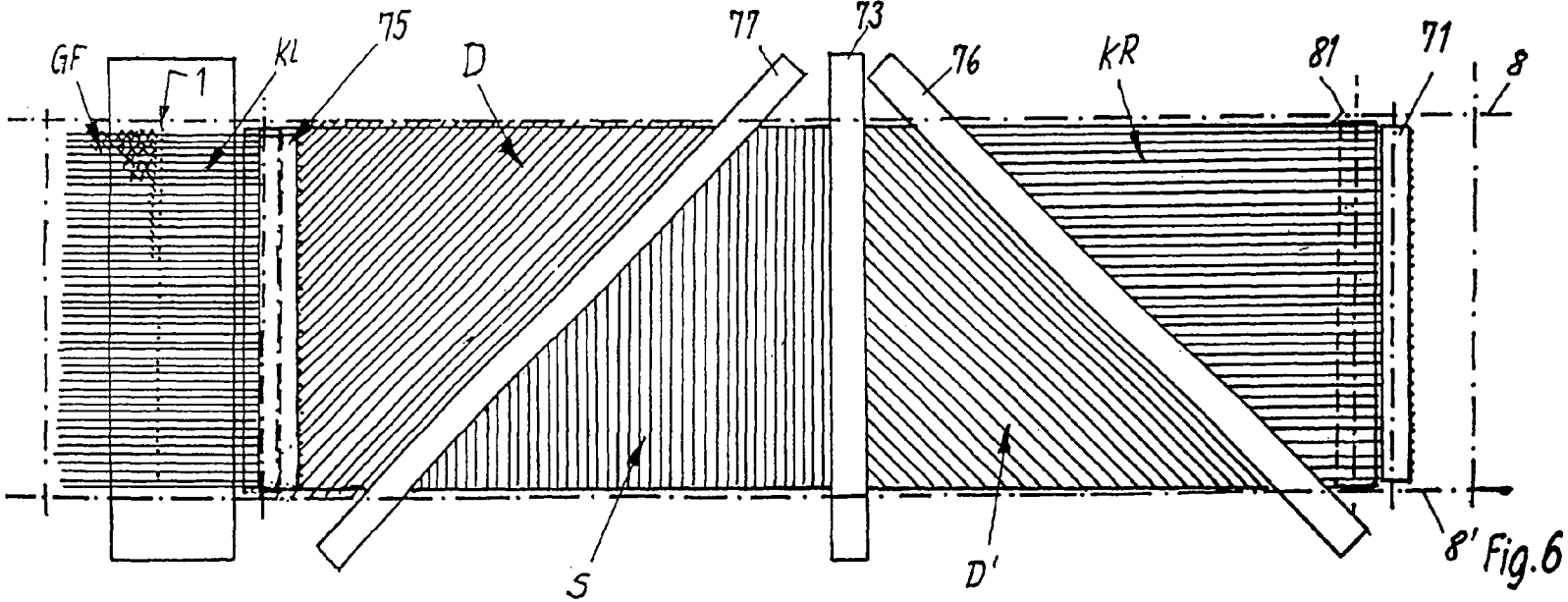
FIG. 6 is a simplified top view of FIG. 5.

In FIG. 6, which illustrates a top view of the system in accordance with FIG. 5, only the upper thread strata of the thread fabric G are shown. In the section outward to the right, we see the stationary thread stratum KR. Following thereover is the first diagonal thread layer D'. Then the stationary thread stratum S, the second diagonal thread layer D, and finally the upper thread layer made of stationary thread KL are laid. The finished, preset thread fabric GF is indicated after the row of knitting needles 1.

Figure 7:
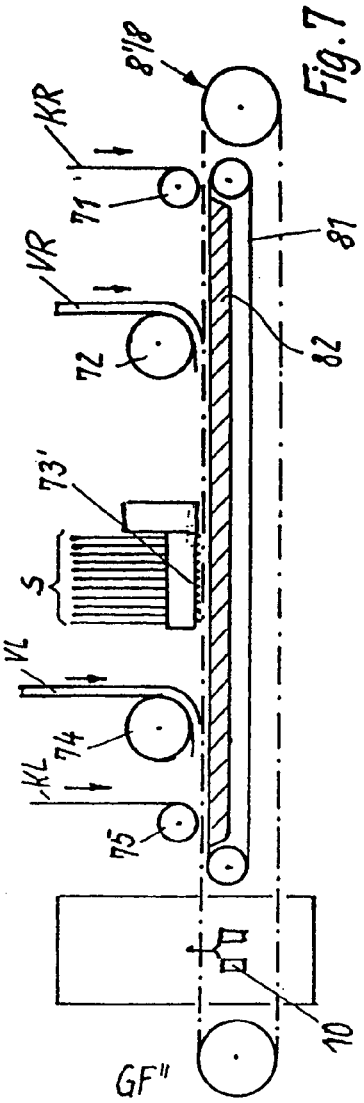
FIG. 7 is a longitudinal section of a modified system.

FIG. 7 illustrates another system for producing a pre-consolidated multistratum thread and/or fiber fabric GF. The basic structure of the system—relative to guiding and conveying the thread fabric—corresponds to that which was described with regard to FIG. 5.

As the first stratum, the lower stationary thread stratum KR is laid for stationary threads onto the conveyor belt 81 by means of the thread supply apparatus 71. This thread supply apparatus 71 is followed by a non-woven fabric supply apparatus 72, which applies across the entire width a more or less voluminous non-woven fabric VR with fiber structures in different directions. A sheet of weft threads S oriented at a right angle to the working direction is stretched onto this non-woven fabric VR between the conveyor chains 8, 8' by means of a weft laying apparatus 73'. A second stratum of non-woven fabric VL is then laid upon these weft threads S by means of a non-woven fabric supply apparatus, before a thread supply apparatus 75 for stationary weft threads applies the upper stationary thread layer KL and finishes the thread fabric G'.

Figure 9:
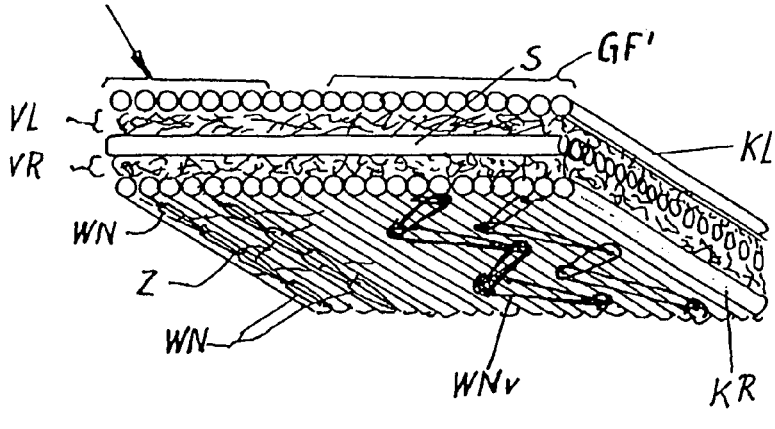
FIG. 9 is a perspective elevation of a thread fabric, the right-hand side of which is set with a system of needle loops and the left-hand side of which is set with a combined weft fiber/system of thread loops.

Such a design of the laying arrangement 7' has the advantage that a substantial portion of the volume of the thread fabric GF'—illustrated in FIG. 9—does not have to be filled using expensive threads. The stability of the thread fabric GF' in the main directions—chain and weft—is defined by pre-laid thread systems KR, KL, S, while the secondary directions are covered by the non-woven fabric strata VR, VL, which largely determine the distance between the threads or fibers in the main directions.

FIG. 9 illustrates the thread fabric GF' produced with the cited system. The lower right-hand side of FIG. 9 illustrates the type of binding of the lowermost thread stratum KR to the thread fabric GF' by means of offset needle loops WNv from the system of loops. Of course, it is also possible to insert this lower stationary thread stratum KR into the system of loops by means of weft fibers Z of limited length. The needle loops WN formed by the conventional wales hold these weft fibers Z and these hold the stationary weft fibers KR with sufficient strength on the thread fabric GF". The weft fibers Z enlarge the volume of the fiber- or thread fabric only by a negligible amount and—as desired—do not have a negative effect on the surface structure.

Figure 8:
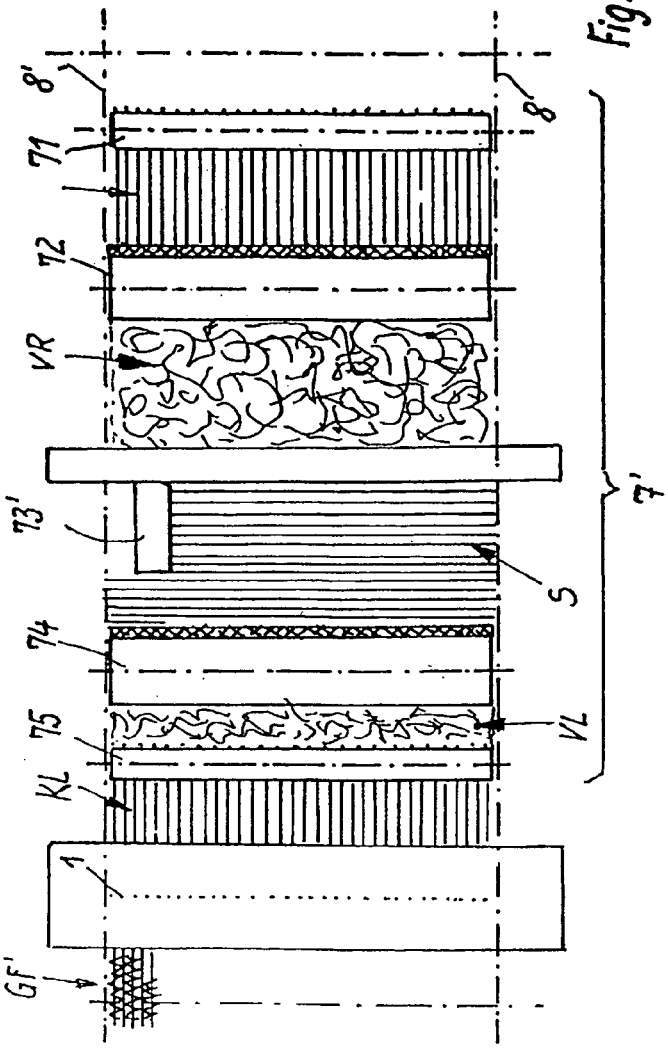
FIG. 8 is a top view of FIG. 7.

FIG. 8 illustrates the laying arrangement 7' in FIG. 7, this time from a top view. It can be seen that the length of the laying arrangement 7' in this embodiment is clearly less than that of laying arrangement 7, which was described with respect to FIG. 5 and FIG. 6.

Figure 10:
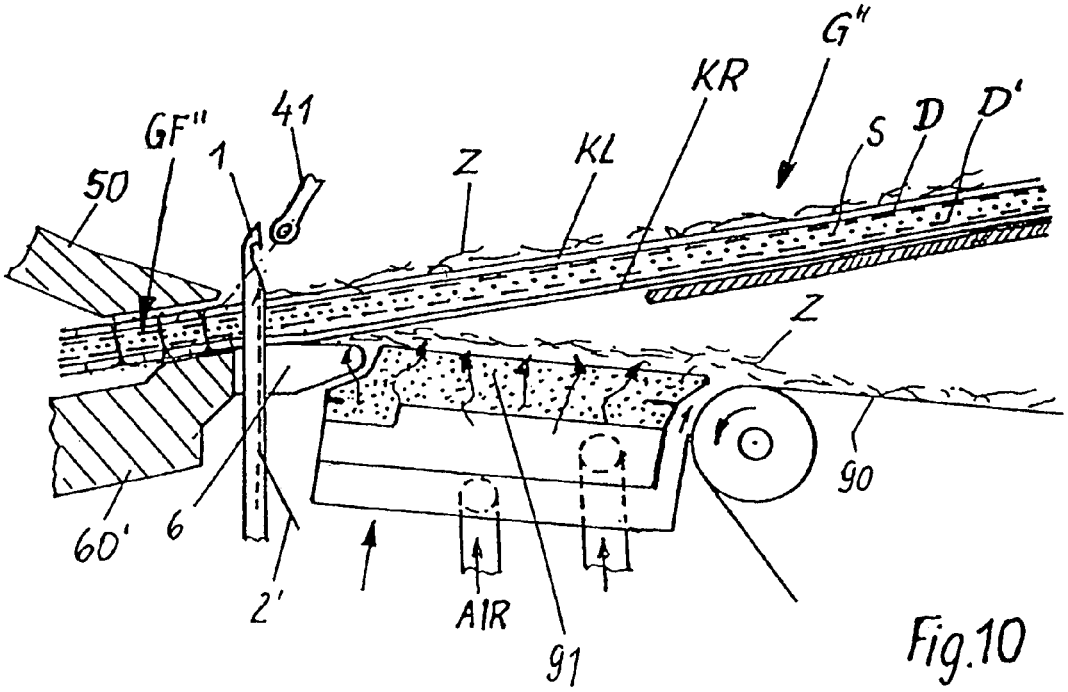
FIG. 10 is a sectional illustration of a loop formation zone with a supply apparatus for fiber snippings on the underside of the thread fabric.

FIG. 10 illustrates a method, already cited with respect to FIG. 9, for setting stationary weft fibers KR on the underside of the thread fabric GF". Using a supply apparatus—the conveyor belt 90—fiber snippings Z in the vicinity of the cast-off plane are fed guided below onto the thread fabric G". These fiber snippings Z are forwarded to the stationary weft stratum KR using an air cushion that is permanently refillable via an air duct bar 91 and are held there until reaching the knock-over bits 6. These fibers Z are joined at a plurality of points to the thread fiber GF" by means of normal, not necessarily laterally displaced needle loops WN, WNv. The weft fibers stretched between wales set the stationary weft fibers KR at irregular intervals on the right-hand side of the knitted fabric.

If the number and density of the fibers Z is limited, they can hardly be perceived visually in the surface structure. However, they satisfy their purpose—namely, pre-setting the cited threads (KR) until the final consolidation of the workpiece.

Figure 11:
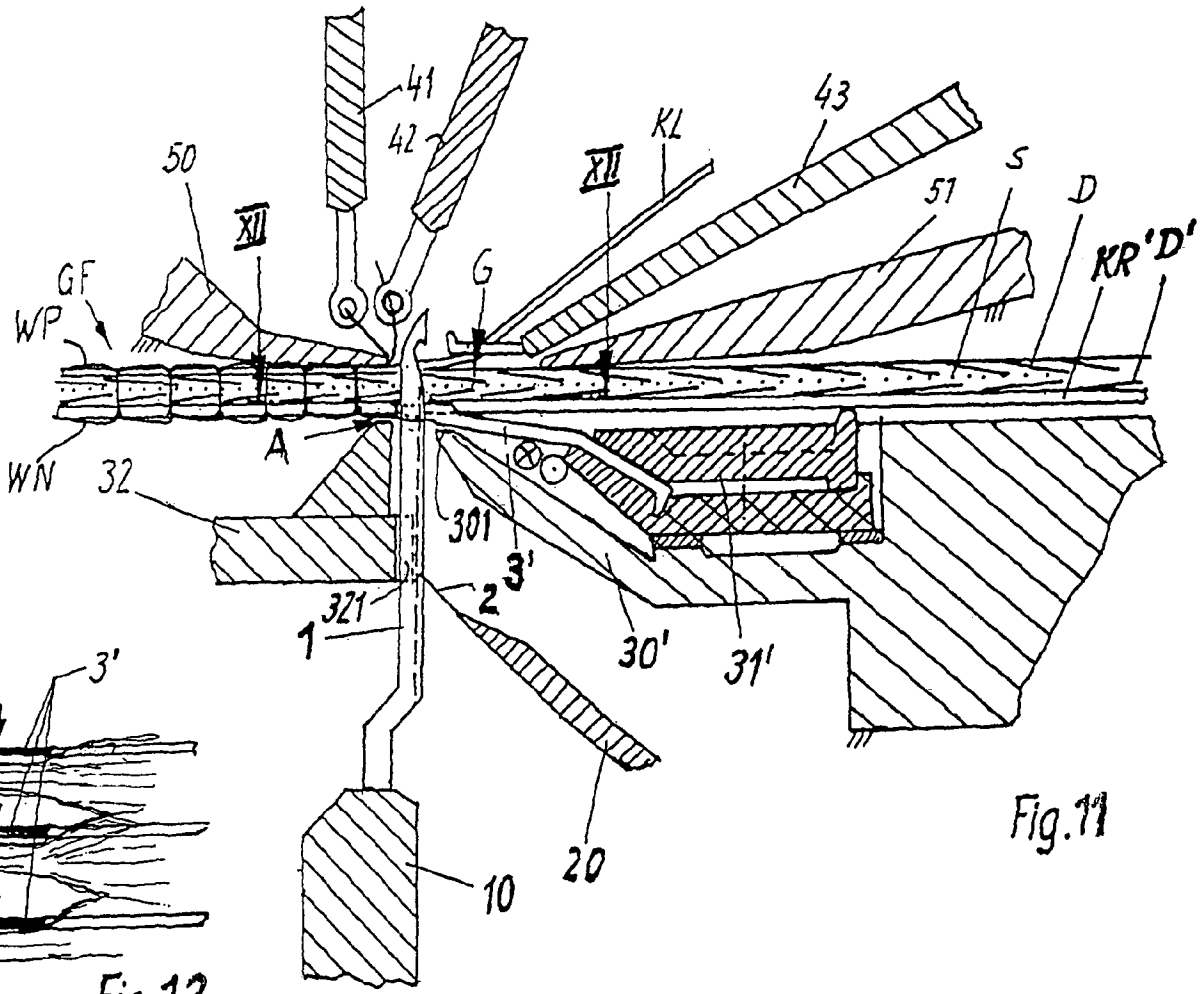
FIG. 11 is a section through the loop formation zone with a laterally displaceable cast-off arrangement for the lowermost stationary thread stratum.
Figure 12:
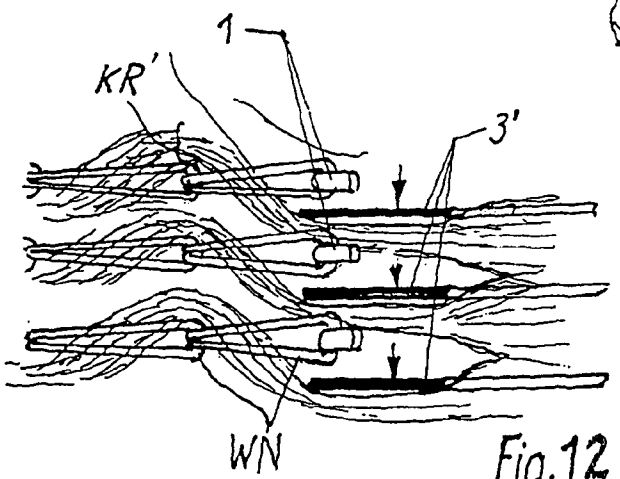
FIG. 12 is a section along the line XII—XII in FIG. 11, parallel to the lowermost thread- or fiber layer.

FIGS. 11 and 12 illustrate another variant for binding the lowermost thread or fiber stratum, which is oriented in the working direction and is set by the needle loops WN of the system of loops. The structure and manner in which the loop formation apparatus works corresponds to the most essential elements in FIG. 1.

The knitting needles 1 of the needle bar 10 and the closing wires 2 of the closing wire bar 20 are not laterally displaced in the cast-off phase—just like the support and guide bar 32'. It is also useful in this case to guide the row of needles 1 to the side, maintaining the same spacing, below the cast-off plane using the support and guide elements 32'.

At the beginning of the casting-off process, the needle loop caught in the needle head is still oriented in the working direction. For attaining a position crossing one of the stationary threads KR between the needle loop WN and the stationary threads, the lowermost stratum of the thread fabric KR' is designed laterally displaceable by the displaceable guide profile of the cast-off element 3'.

In the phase of casting off the needle bar 10, the cast-off element 3' of the cast-off bar 30' laterally displaces the fibers or threads of the lowermost stratum KR' of the thread fabric G by approximately one needle gauge, so that a section of the fibers separated from the sheet is displaced across the needle loop leg. Only the lowermost thread or fiber stratum KR' is displaced by this process and reliably set on the system of loops.

The deflection of the stationary threads or stationary fibers KR during the production of the system of loops, as it is indicated in FIG. 12, is removed after the system of loops is finished. An equalized tension is set at which the stationary threads or stationary fibers KR' are oriented nearly straight in the working direction.

Furthermore, in the method it seldom occurs that all of the fibers or thread parts in each row of loops cross the leg of the needle loop. However, the connection to the other layers of the thread fabric G is sufficiently secure in one area across a plurality of loop rows that the thread fabric GF can be cast-in during a subsequent process and can set in the final shape.

LEGEND

1 Knitting needle/slide needle
10 Knitting needle bar or slide needle bar
2 Closing wire, slider
20 Closing wire bar, slider bar
3, 3' Cast-off element
30, 30' Cast-off bar
301 Support surface
31, 31' Clamping bar
32, 32' Support and guide bar
321 Guide projections
33 Support bar
331 Support surface
332 Fiber divider
41 Working thread guide (guide bar)
42 Working thread guide (guide bar)
43 Stationary thread guide
50 Counter bar
51 Counter bar
6 Knock-over bits
60, 60' Cast-off bar
61 Cast-off nose

62 Guide profile
7, 7' Laying arrangement
71 Thread supply apparatus (for stationary weft threads)
72 Non-woven fabric supply apparatus
73, 73' Weft laying apparatus
74 Non-woven fabric apparatus
75 Thread guide apparatus (for stationary weft threads)
76 Thread laying apparatus (diagonal-1)
77 Thread laying apparatus (diagonal-2)
8, 8' Conveyor chains
81 Conveyor belt
82 Guide plate
90 Supply apparatus, conveyor belt
91 Air duct bar
D, D' Diagonal thread layer
G, G', G" Thread fabric, fabric
GF, GF', GF" Thread fabric, pre-consolidated
(K) Stationary thread, reinforcing element
KL Stationary thread, reinforcing element (left-hand side of knitted fabric)
KR, KR' Stationary thread, reinforcing element (right-hand side of knitted fabric)
KRT Fiber strand, divided, bound
S Stationary threads, stationary thread layer
Z Fiber snippings, weft fibers
W Working threads
WP Plate loop
WN Needle loop
WNv Needle loop, displaced
V L Non-woven fabric, reinforcing element
VR Non-woven fabric, reinforcing element

What is claimed is:

1. Method of producing a preconsolidated elongated multi-strata fabric suitable for reinforcing plastic or resin articles, each of said strata being oriented differently from adjacent said strata and being comprised of thread or fiber sheets, at least one of said strata being a stationary weft stratum, each said stationary weft stratum being comprised of thread or fiber sheet oriented at least substantially parallel to a machine direction, the method comprising forming at least one stationary weft stratum by forming a sheet of threads or fibers stretched between rows of hooks on laterally spaced substantially parallel conveyor chains thereby to produce at least one thread or fiber fabric, said stationary weft stratum being a lowermost stratum of said multi-strata fabric;

transporting said at least one thread or fiber fabric by means of said conveyor chains in a working direction to a warp knitting machine;

by means of said warp knitting machine forming loops which bind threads or fibers of all said strata comprised of a respective thread or fiber fabric thereby to form a preconsolidated thread or fiber multi-strata fabric;

penetrating the multi-strata fabric with the needles of the warp knitting machine and forming needle loops, the lowermost stratum being immediately adjacent the needle loops, the needle loops comprising legs which in a stage of a row of needle loops being cast off cross one another due to a relative mutual displacement of the needle loops and the stationary weft threads relative to a preceding site at which a preceding row of needle loops were formed to bind said threads or fibers; and subsequently penetrating said multi-strata fabric again with the row of needles to form a subsequent row of loops additionally binding said threads or fibers.

2. Method according to claim 1, wherein the threads or fibers of the lowermost stationary weft stratum are supported upstream and downstream of the needles;

the threads or fibers of the lowermost stationary weft stratum are stretched in the working direction against pressure applied to the threads or fibers by the casting off and the stretched threads or fibers guide the lowermost stationary weft stratum in a plane of the casting off across a plane of the needles; and needle loops guided by the needles, after crossing over threads or fibers of the lowermost stationary weft stratum, are deposited and cast off with the aid of needle loops of the subsequent row of loops.

3. Method according to claim 1, wherein the lowermost weft stratum is supported on cast off elements of the warp knitting machine by means of profiled guide surfaces oriented in a direction in which the preset multi-strata fabric produced by the method is taken up and is guided against lateral deflection.

4. Method according to claim 1, wherein the threads or fibers of the lowermost stationary weft stratum are laterally displaced during the cast off stage by at least one needle gauge by means of profiled guide surfaces oriented in a direction in which the preset multi-strata fabric produced by the method is taken up and by laterally displaceable cast off elements; and the needle loops are guided by the needles, which cannot be laterally displaced, after displacement of the threads or fibers of the lowermost stationary weft stratum, and are knocked off by the needle loops by the subsequent row of loops.

5. Method according to claim 1, wherein transversely oriented weft fibers of predetermined length are fed between a plane of the casting off and the lowermost stationary weft stratum and are bound in the multi-strata fabric by the needle loops.

6. Method according to claim 1, wherein the threads or fibers of the stationary weft stratum are guided into a plane of the casting off as the lowermost stratum of the multi-strata fabric, threads or fibers of the latter being first deposited on a moving conveyor belt.

7. Method according to claim 1, further comprising arranging an additional stationary weft stratum comprised of stationary weft threads or fibers as an uppermost stratum, and wherein the knitting machine comprises a working thread guide and a needle bar and the needle bar is operated for tricot laying and the working thread guide is operated with even pattern notation or counter notation relative to displacement of the needle bar.

8. Method according to claim 7, further comprising arranging between said uppermost stratum and said lowermost stratum at least two strata comprised of threads which are diagonal to the machine direction and, between said diagonal strata, a stratum comprised of threads which are at substantially a right angle to the working direction.

9. Method according to claim 8, wherein between said uppermost stratum and said lowermost stratum are arranged at least two strata comprised of threads which are at substantially a right angle to the working direction.

10. Method according to claim 7, further comprising arranging between the uppermost stratum and the lowermost stratum two strata comprised of tangled fibers and, between said tangled fibers strata, a stratum comprised of threads or fibers which are at substantially a right angle to the working direction.

11. Apparatus for producing a preconsolidated elongated multi-strata fabric, comprising a pair of substantially parallel conveyor chains provided with hooks for engaging threads or fibers stretched between the conveyor chains;

a thread or fiber supply apparatus for stationary weft threads or fibers;

at least one thread or fiber laying apparatus for forming a thread or fiber sheet comprised of threads or fibers stretched between the conveyor chains;

a conveyor belt arranged between the conveyor chains for supporting and transporting a thread or fiber fabric;

a warp knitting machine having knitting needles arranged for transversely penetrating the thread or fiber sheet and fabric in a casting off plane in a loop formation zone of the knitting machine;

guide elements for the conveyor chains arranged between the laying apparatus and the loop formation zone;

in an entry area of the laying apparatus, a thread or fiber supply apparatus for stationary weft threads for guiding a sheet of stationary weft threads to form a lowermost stratum of the multi-strata fabric;

a cast off bar of the knitting machine at least a part of which is arranged on a side of the needle face of the knitting needles and in proximity thereto; and associated with the cast off bar, guide elements which counter force applied in the cast off direction and for lateral guidance of the thread or fiber fabric against displacement of thread or fiber loops formed by the knitting needles.

12. Apparatus according to claim 11, wherein the knitting machine is a stitch bonding machine.

13. Apparatus according to claim 11, further comprising a knitting needle bar of the knitting machine adapted to be operated by a lift drive and by a displacement drive for displacing the needle bar across at least one needle gauge.

14. Apparatus for producing a pre-consolidated elongated multi-strata fabric, comprising a pair of substantially parallel conveyor chains provided with hooks for engaging threads or fibers stretched between the conveyor chains;

a thread or fiber supply apparatus for stationary weft threads or fibers;

at least one thread or fiber laying apparatus for forming a thread or fiber sheet comprised of threads or fibers stretched between the conveyor chains;

a conveyor belt arranged between the conveyor chains for supporting and transporting a thread or fiber fabric;

a warp knitting machine having knitting needles arranged for transversely penetrating the thread or fiber sheet and fabric in a casting off plane in a loop formation zone of the knitting machine;

guide elements for the conveyor chains arranged between the laying apparatus and the loop formation zone;

in an entry area of the laying apparatus, a thread or fiber supply apparatus for stationary weft threads for guiding a sheet of stationary weft threads to form a lowermost stratum of the multi-strata fabric;

apparatus for supplying a stratum of tangled fibers of predetermined length, arranged below the thread or fiber fabric and immediately in front of a cast off bar of the warp knitting machine; and between the apparatus for supplying a stratum of tangled fibers and the cast off bar, means for holding the fibers of predetermined length on the lowermost stratum.

15. Apparatus according to claim 14, wherein the means for holding the fibers of predetermined length on the lowermost stratum comprises an air duct bar.

16. Preconsolidated elongated thread or fiber multi-strata fabric suitable for reinforcing articles comprised of resin or plastic, the fabric comprising a lowermost stratum comprised solely of thread or fiber sheet oriented at least in part as stationary weft threads or fibers substantially parallel to a longitudinal axis of the multi-strata fabric; and needle loops formed by needles of a knitting machine, the needle loops having legs binding the stationary weft threads or fibers.

17. Preconsolidated elongated thread or fiber multi-strata fabric according to claim 16, further comprising an uppermost stratum comprised solely of thread or fiber sheet oriented at least in part as stationary weft threads or fibers substantially parallel to a longitudinal axis of the multi-strata fabric; and plate loops formed by the needles binding the stationary weft threads or fibers of the uppermost stratum.

18. Preconsolidated elongated thread or fiber multi-strata fabric according to claim 17, further comprising between the uppermost stratum and the lowermost stratum, transversely oriented weft threads or fibers of predetermined length, and wherein the needle loops and the plate loops also bind the transversely oriented weft threads or fibers.

* * * * *